United States Patent [19]

Shida

[11] Patent Number: 4,479,723

[45] Date of Patent: Oct. 30, 1984

[54] ANALOG ELECTRONIC TIMEPIECE DRIVE CIRCUITRY FOR ENERGIZING STEPPING MOTOR DRIVE COIL IN FULL AND INTERMEDIATE EXCITATION STATES, AND METHOD THEREFOR

[75] Inventor: Masaharu Shida, Tokyo, Japan

[73] Assignee: Seiko Instruments & Electronics Ltd., Tokyo, Japan

[21] Appl. No.: 266,213

[22] Filed: May 22, 1981

[30] Foreign Application Priority Data

May 23, 1980 [JP] Japan ..... 55-68450

[51] Int. Cl.[3] ..... G04F 5/00

[52] U.S. Cl. ..... 368/157; 368/160

[58] Field of Search ..... 368/76, 80, 157, 216, 368/217, 160, 85

[56] References Cited

U.S. PATENT DOCUMENTS

| | | | |
|---|---|---|---|
| 4,254,491 | 3/1981 | Haub et al. | 368/217 |
| 4,271,496 | 6/1981 | Shida et al. | 368/80 |
| 4,315,329 | 2/1982 | Torisawa et al. | 368/76 |
| 4,340,946 | 7/1982 | Kanno et al. | 368/157 |
| 4,361,410 | 11/1982 | Nakajima et al. | 368/157 |

FOREIGN PATENT DOCUMENTS

| | | | |
|---|---|---|---|
| 2035625 | 6/1980 | United Kingdom | 368/157 |

*Primary Examiner*—Bernard Roskoski

*Attorney, Agent, or Firm*—Robert E. Burns; Emmanuel J. Lobato; Bruce L. Adams

[57] ABSTRACT

An analog electronic timepiece comprises a stepping motor having a stator, rotor and drive coil, and electronic circuitry for periodically energizing the drive coil in two distinct excitation states to rotationally drive the rotor in a stepwise manner. The electronic circuitry effects sequential energization of the drive coil in first a full excitation state which is effective to at least initiate driving of the rotor from an initial position through a predetermined angle of rotation to a new position, and then in an intermediate excitation state which is effective to ensure completion of the driving of the rotor through the predetermined angle of rotation by preventing return rotation of the rotor after the rotor has advanced through a certain angular extent towards its new position.

A method of operating a stepping motor of an analog electronic timepiece comprises periodically energizing the drive coil of the stepping motor by first energizing the drive coil in a discrete full excitation state to initiate driving of the rotor through one rotational step, and then energizing the drive coil in a discrete intermediate excitation state to complete the driving of the rotor through the rotational step.

35 Claims, 20 Drawing Figures

ANALOG ELECTRONIC TIMEPIECE DRIVE CIRCUITRY FOR ENERGIZING STEPPING MOTOR DRIVE COIL IN FULL AND INTERMEDIATE EXCITATION STATES, AND METHOD THEREFOR

BACKGROUND OF THE INVENTION

The present invention pertains generally to analog electronic timepieces which incorporate stepping motors to rotationally drive the timepiece hands, and more particularly to improvements in the manner of energizing the motor coil to obtain stable operation of the stepping motor.

Conventional analog electronic timepieces, such as watches, clocks and the like, employ stepping motors to rotationally drive the timepiece hands through suitable gearing. The stepping motors comprise a stator, rotor and drive coil, and circuitry incorporated in the timepiece generates and applies drive signals of alternate polarity to the drive coil to excite the coil and accordingly rotationally drive the rotor. Typically, the drive signals are in the form of drive pulses of alternate polarity, the drive pulses having sufficient pulse width and height to suitably excite the drive coil so as to impart the necessary drive torque to rotationally drive the rotor under normal load conditions.

These prior art constructions suffer the drawback that they require precise timing of the application of the drive pulses to the drive coil and improper timing results in mis-operation of the stepping motor. For example, if the drive pulses are cut off too soon, insufficient torque will be applied to the rotor to rotationally advance the rotor to its next rest position and the rotor will return back to its previous rest position thereby causing the stepping motor to miss rotations.

SUMMARY OF THE INVENTION

It is, therefore, one object of the present invention to provide an analog electronic timepiece which overcomes the aforementioned drawbacks of the prior art analog electronic timepieces.

Another object of the present invention is to provide an analog electronic timepiece which effectively eliminates mis-operation of the stepping motor due to slight variations in the timing of the drive pulses applied to the motor drive coil.

A further object of the present invention is to provide an analog electronic timepiece having circuitry for sequentially energizing the drive coil in two discrete excitation states in order to obtain stable motor operation.

A still further object of the present invention is to provide an analog electronic timepiece having circuitry for energizing the drive coil of the stepping motor in such manner to ensure rotor rotation without unduly increasing electric power consumption of the timepiece battery.

Another object of the present invention is to provide a method of operating a stepping motor of an analog electronic timepiece to obtain stable operation of the motor.

The above and other objects of the invention are achieved by an analog electronic timepiece comprised of a stepping motor having a stator, rotor and drive coil, and electronic circuitry for periodically energizing the drive coil in two distinct excitation states to rotationally drive the rotor in a stepwise manner. The electronic circuitry effects sequential energization of the drive coil in first a full excitation state which is effective to at least initiate driving of the rotor from an initial position through a predetermined angle of rotation to a new position, and then in an intermediate excitation state which is effective to ensure completion of the driving of the rotor through the predetermined angle of rotation by preventing return rotation of the rotor after the rotor has advanced through a certain angular extent towards its new position.

The method of operating a stepping motor of an analog electronic timepiece comprises periodically energizing the drive coil of the stepping motor by first energizing the drive coil in a discrete full excitation state to initiate driving of the rotor through one rotational step, and then energizing the drive coil in a discrete intermediate excitation state to complete the driving of the rotor through the rotational step.

Having in mind the above objects as well as other objects of the invention which will become apparent from a reading of this disclosure, the present invention comprises the analog electronic timepieces and the method of operating stepping motors of analog electronic timepieces as illustrated in the presently preferred embodiments which are hereinafter set forth in sufficient detail to enable those persons ordinarily skilled in the art to clearly understand the manner of practicing the invention when the disclosure is read in conjunction with the accompanying drawings.

In order to prevent this unstable operation of the stepping motor, it has been necessary to severely restrict the freedom of design of the timepiece movement. Battery-powered timepieces, such as wristwatches, usually employ lithium cells, silver peroxide cells or some secondary battery which can be recharged by a battery charger for use as the electric power supply. However, in all of these cases, the supply voltage either initially varies, gradually varies during the life of the battery, or temporarily varies due to environmental changes or changes in the load on the motor. The motor drive systems presently available do not adequately ensure stable motor operation during periods of probable supply voltage variation.

Figure 1:
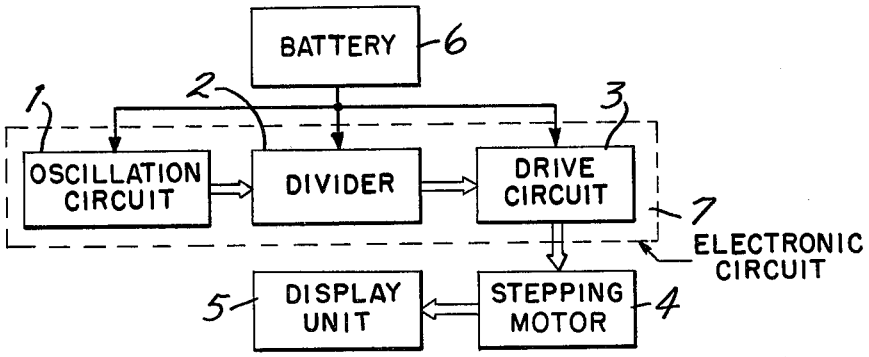
FIG. 1 PRIOR ART
FIG. 1 is a block diagram of a representative prior art analog electronic timepiece.
Figure 2:
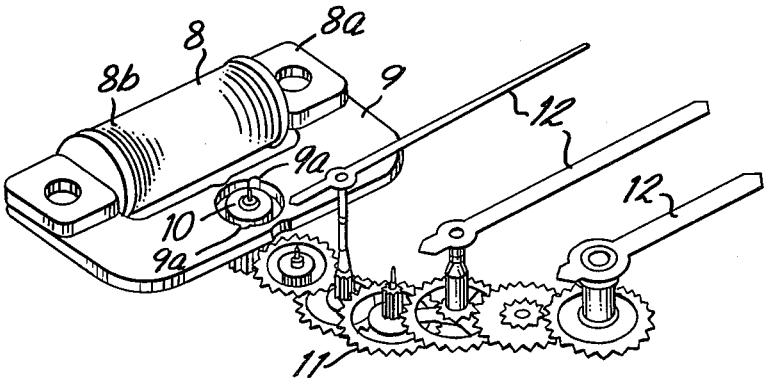
FIG. 2 PRIOR ART
FIG. 2 is a perspective, schematic view of a typical prior art stepping motor, gear train and display unit.
Figure 3:
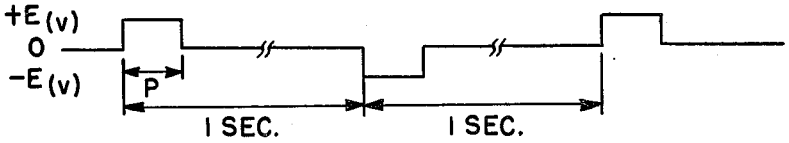
FIG. 3 PRIOR ART
FIG. 3 is a waveform of conventional drive pulses for use in energizing the drive coil of the stepping motor.
Figure 4:
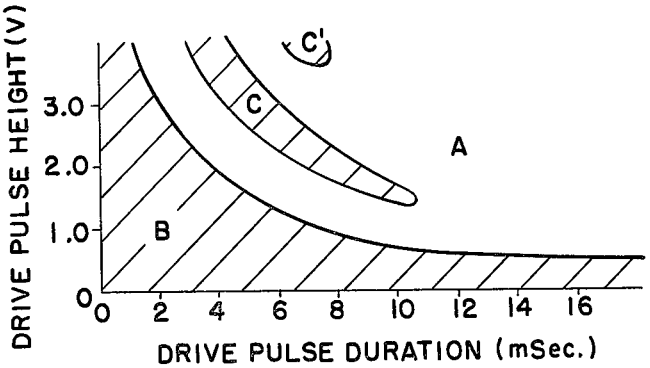
FIG. 4 PRIOR ART
FIG. 4 is an explanatory graph showing the available operation region of drive pulses as a function of drive pulse duration (width) and height.
Figure 5A:
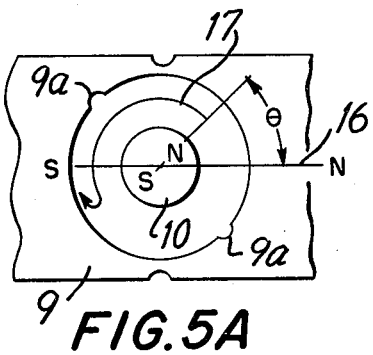
FIG. 5A PRIOR ART
FIGS. 5A and 5B are explanatory views illustrating the manner of rotation of the rotor by application of drive pulses to the drive coil.
Figure 5B:
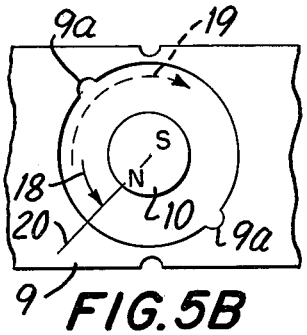
FIG. 5B PRIOR ART
Figure 6:
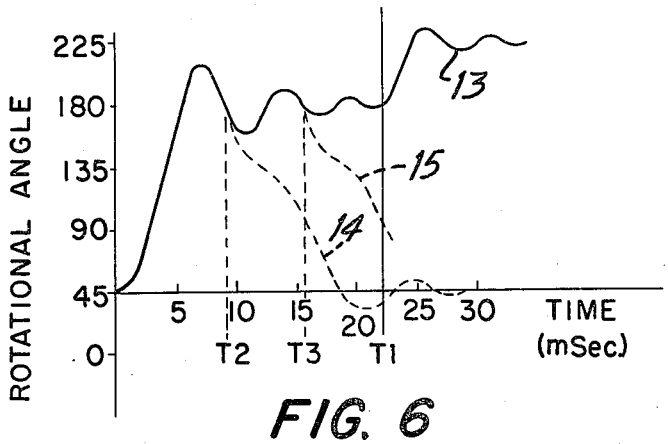
FIG. 6 PRIOR ART
FIG. 6 is a graph showing the variation of the rotational angle of the rotor with respect to time when a drive pulse is applied to the drive coil.

As shown in FIG. 4, one solution to this problem would appear to be selecting drive pulses having a pulse duration on the order of 11 msec. and sufficient pulse height so as to have a broad tolerance to compensate for supply voltage variations. However, the use of drive pulses having such a long pulse duration would consume enormous electric power and thus would be counterproductive to electronic timepiece design which requires batteries of long life and small size.

According to the present invention, the mis-operation of the rotor in the unstable rotation regions has been eliminated by energizing the coil of the stepping motor in such manner to prevent premature cutoff of the drive pulse timing. The drive system of the invention effects energization of the drive coil to a full excitation state in a normal manner and then, immediately thereafter, effects energization of the drive coil in an intermediate excitation state which consumes about 10 to 70% of the electric power consumed in the full excitation state. The intermediate excitation state of the drive coil effects a corresponding intermediate excitation of the stator 9 and functions to stabilize the rotational movement of the rotor 10 after the drive pulses are partly cut off. Stated otherwise, the intermediate excitation state prevents full cutoff of the drive pulses and instead, extends the application of the drive pulses a short period of time, though at a lower power, to prevent mis-operation of the motor.

Figure 8:
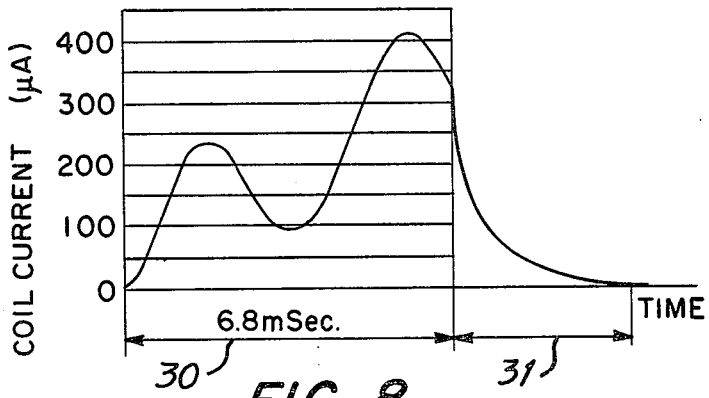
FIG. 8 PRIOR ART
FIG. 8 is a waveform of the current flowing through the drive coil due to one drive pulse in a prior art analog electronic timepiece.
Figure 7:
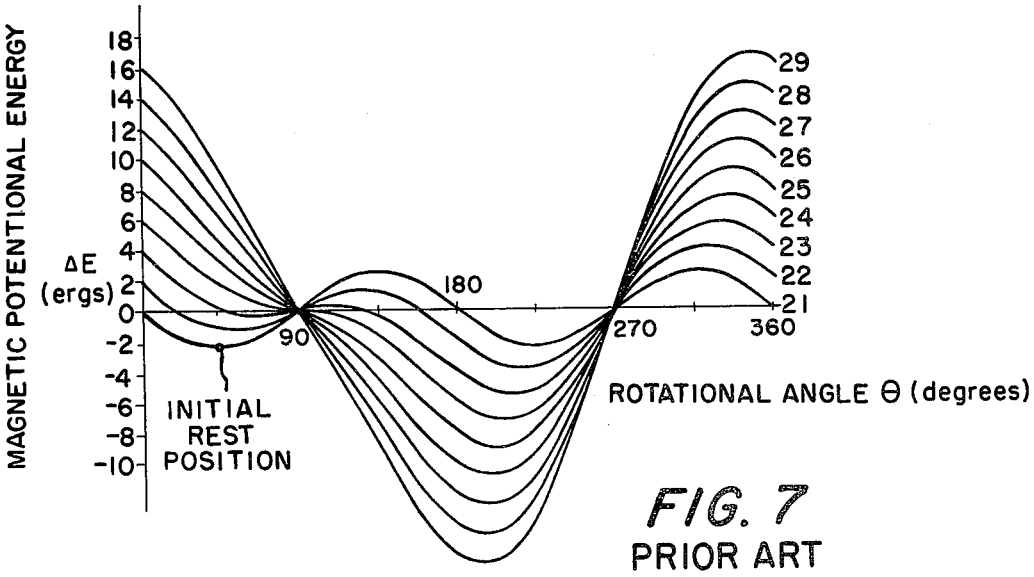
FIG. 7 PRIOR ART
FIG. 7 is a graph showing the relationship between the rotational angle of the rotor and various mangetic potential energy curves of the rotor.

FIG. 7 is a graph showing a family of magnetic potential energy curves for different rotational angles of the rotor 10. The different curves are numbered 21 through 29 and each curve corresponds to a different excitation state of the stator 9 caused by different values of current flowing through the drive coil 8. FIG. 8 is a waveform of the current flowing in the drive coil 8 due to one drive pulse and for purposes of explanation, FIG. 8 shows the current waveform during an energization period in which mis-operation of the motor has occurred. The current flowing through the coil during the time period 30 represents current flow occurring during the duration of the drive pulse, i.e., during the time that the drive pulse is being applied to the drive coil, and the current waveform in the time period 31 represents the current flowing in a closed circuit which includes the coil and which occurs after the drive pulse is cut off. It is understood that electric power supplied by the battery is dissipated only during the time period 30 which corresponds to the drive pulse duration.

At any given instant when current is flowing through the drive coil 8 during the application of a drive pulse, the magnetic potential energy of the rotor corresponds to one of the magnetic potential energy curves 21–29 depending on the value of the excitation current. The value of the excitation current varies with time in the manner shown in FIG. 8 and is one of the parameters which determine the magnetic potential energy. Thus the drive torque of the rotor at any given time corresponds to one of the magnetic potential curves and the rotational angle of the rotor—both of which vary with time.

By way of example, a discussion will be given of a mis-operation of the motor due to cutoff of the drive pulse. Assume the case in which a drive pulse is applied to the drive coil 8 to energize the coil and excite the stator 9 to initiate forward rotational movement of the rotor 10 from an initial rest position to a new rest position. As the rotor approaches the new rest position, it oscillates in the forward and reverse directions and for purposes of discussion, consider the case in which the rotor is undergoing movement in the reverse direction from a rotational angle $\theta=270°$ to the angle $\theta=180°$. At this moment, the magnetic potential energy of the rotor corresponds to one of the curves 26, 27, 28 because the value of the current flowing through the drive coil at this moment is close to its peak value. As evident from FIG. 7, these magnetic potential energy curves 26, 27 and 28 abruptly decline in a negative sense so that the rotor is subjected to a large reverse rotational force which tends to keep the rotor rotating in the reverse direction. If the drive pulse is then cut off at the end of the time period 30, the current flowing through the drive coil 8 abruptly dampens within the time period 31. The abrupt dampening of the current causes the magnetic potential energy of the rotor to abruptly shift from one of the high magnetic potential energy curves 26, 27 or 28 to one of the low magnetic potential energy curves 21, 22 or 23. As shown in FIG. 7, these low magnetic potential energy curves 21, 22 and 23 have a relatively small positive value of magnetic potential energy at a rotational angle $\theta$ of about 135°. Consequently, the inertial force of the rotor, which at this moment is undergoing reverse rotation, is sufficient to overcome this small positive magnetic potential energy whereupon the rotor continues movement in the reverse direction and returns to its initial rest position. Stated otherwise, the small forward rotational force exerted by the relatively low value of positive magnetic potential energy in the region of the rotational angle $\theta$ of about 135° is insufficient to overcome the inertial force of the rotor so that the rotor returns to its initial rest position rather than advancing one step to its new rest position. This type mis-operation of the motor occurs when the motor operates in the unstable rotation regions.

Such mis-operation of the motor is avoided according to the present invention by providing circuitry for preventing abrupt dampening of the current flowing through the drive coil during the time period 31 so that the magnetic potential energy of the rotor is maintained along one of the higher magnetic potential energy curves for a short period of time after the drive pulse is cut off. This is achieved by energizing the drive coil during the time period 31 to a level of energization which is less than that obtained by the drive pulse though sufficient to forcedly attenuate the oscillation of the rotor in a gradual manner thereby ensuring that the rotor advances one step to its next rest position when energization of the drive coil is completely cut off. As used throughout the specification and claims, the phrase "intermediate excitation state" corresponds to the energization of the drive coil and the corresponding excitation of the stator which occurs during the time period 31. The phrase "full excitation state" corresponds to the energization of the drive coil and the corresponding excitation of the stator which occurs during the time period 30 which, in the prior art, is the only time during which the drive coil is energized.

There are many ways in which to obtain the intermediate excitation state of the drive coil. One way is to connect an impedance in series with the drive coil to a plurality of switching devices which are enabled only during the period of the intermediate excitation state. Another, and more simple, way is to apply suitable drive signals to the drive coil to effect sequential energization thereof in the full and intermediate excitation states.

Figure 9:
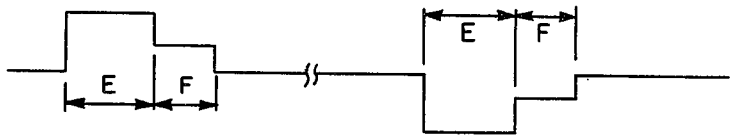
FIGS. 9, 10A, 10B and 10C are drive pulse waveforms generated by electronic circuitry according to the present invention.

FIG. 9 shows one embodiment of drive signals according to the invention. The drive signals are of alternate polarity and each drive signal has a first signal component corresponding to the conventional drive pulse and a second signal component which is of smaller pulse height and smaller pulse duration than the first signal component. The first signal component is effective to energize the drive coil in the full excitation state and the second signal component is effective to energize the drive coil in the intermediate excitation state. The period during which the first signal component is applied to the drive coil is denoted E and the period during which the second signal component is applied to the drive coil is denoted F. The drive signals comprise compound drive pulses having a normal drive pulse component analogous to conventional drive pulses for energizing the drive coil in the full excitation state, and a secondary drive pulse component for energizing the drive coil in the intermediate excitation state.

Figure 10A:
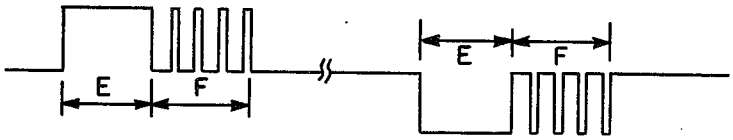
Figure 10B:
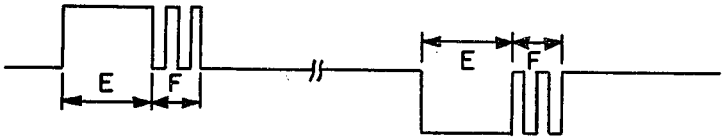
Figure 10C:
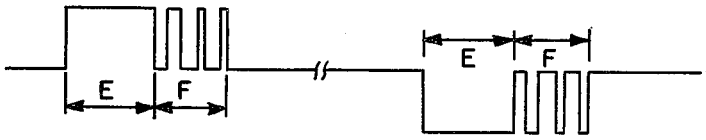

FIGS. 10A, 10B and 10C show drive signals according to the invention in which the second signal component comprises a plurality of short duration pulses for energizing the drive coil in the intermediate excitation state. The drive signals are in the form of compound drive pulses having normal and secondary drive pulse components. The second signal components (secondary drive pulse components) of the drive signal shown in FIGS. 10A, 10B and 10C are each comprised of plural pulse sets having a different number of pulses in each set and each set having a different duration F. Further, the plural pulses in each set of drive signal shown in FIGS. 10A, 10B and 10C have different duty ratios (ON interval to OFF interval ratios) and have different pulse widths. The compound drive pulses shown in FIG. 10C have a secondary drive pulse component comprised of a plurality of pulses at least some of which have pulse widths different than others. These several examples of drive signals are exemplary only of the many types which can be utilized to effect sequential energization of the drive coil according to the principles of the present invention. In actual practice, the duration of the intermediate excitation state F and the particular waveforms of the drive signals including the number of pulses, pulse width and duty cycle of the plural pulses making up the secondary drive pulse component are determined in accordance with the desired motor operating characteristics and the motor specifications, tolerance requirements, expected supply voltage variation and other factors well known to those skilled in the timepiece art.

Figure 11:
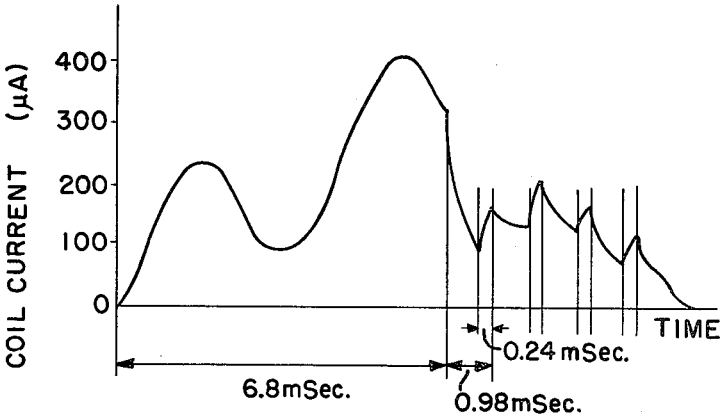
FIG. 11 is a waveform of the current flowing through the drive coil due to the drive pulse shown in FIG. 10A according to the present invention.

A detailed explanation will now be given of the manner by which the drive signals such as shown in FIGS. 9, 10A, 10B and 10C effect energization of the drive coil in the full and intermediate excitation states. FIG. 11 is a waveform of the current flowing through the drive coil due to one of the drive signals shown in FIG. 10A. The drive signal comprises a compound drive pulse having a normal drive pulse component of duration E of 6.8 msec., and a secondary drive pulse component of duration F comprised of four pulses each having a pulse width of 0.24 msec. and a pulse period of 0.98 msec. In this example, the four pulses of the secondary drive pulse component have a duty cycle of 25% which corresponds to an on-and-off ratio of 1:3. During the time period E of application of the normal drive pulse component, the drive coil is energized in its full excitation state to initiate driving of the rotor from an initial rest position through a predetermined angle of rotation to a new rest position corresponding to one step. The normal drive pulse component cuts off at the end of the period E and at this moment the rotor has not yet reached its new rest position but rather is in an oscillatory state. During the time when the rotor is in the oscillatory state, the second drive pulse component is applied to the drive coil during the time period F to effect energization of the drive coil in the intermediate excitation state and corresponding excitation of the stator. As shown in FIG. 11, the effect of the intermediate excitation state is to prevent abrupt dampening of the current flow through the drive coil thereby preventing return rotation of the rotor back to its initial position. Even though the energization of the drive coil is periodically interrupted during the intermediate excitation state, the current flowing through the drive coil is substantially leveled due to the coil inductance so that the intermediate excitation state is stably maintained. The beneficial effect of the invention can be seen by comparing the manner of decay of the drive coil current according to the prior art shown in FIG. 8 and according to the invention shown in FIG. 11. Since the electric power supplied from the battery is only consumed during the ON intervals of the plural pulses of the secondary drive pulse component, the amount of electric power consumption required to energize the drive coil in the intermediate excitation state is rather minimal and does not cause any appreciable drain of the battery.

Figure 12:
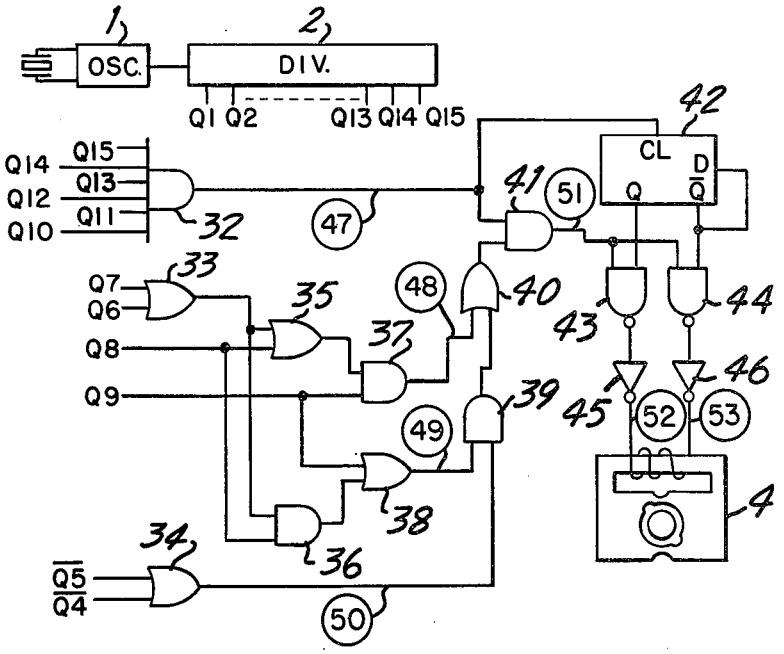
FIG. 12 is a circuit diagram of electronic circuitry for generating drive signals according to the present invention.

A description will now be given of one embodiment of circuitry which can be used to energize the drive coil in full and intermediate excitation states according to the principles of the invention with reference to FIGS. 12 and 13. FIG. 12 is a circuit diagram of electronic circuitry embodied in an analog electronic timepiece according to the invention. A crystal oscillator 1 generates a high frequency time reference signal of 32,768 Hz suitable for use as a time standard. The high frequency signal from the oscillator is fed to a multistage divider 2 which successively divides the high frequency signal into a plurality of different lower frequency signals Q1 of 16,384 Hz, Q2 of 8192 Hz . . . Q15 of 1 Hz. Logic circuitry processes and combines the lower frequency signals to obtain drive signals of alternate polarity which are fed to a stepping motor 4. The logic circuitry comprises AND gates 32, 36, 37, 39 and 41 and OR gates 34, 35, 37, 38 and 40 interconnected in the manner shown. A D-flip-flop 42 has a clock terminal CL connected to receive the output signal of the AND gate 32 and switches logic states at its outputs Q and $\overline{Q}$ in response to each input pulse applied to the clock terminal CL. A pair of inverters 45 and 46 are connected to respective ends of the drive coil and function as buffers. The waveforms 47–53 of the signals shown in FIG. 13 appear at the points indicated in the circuity of FIG. 12.

In operation, the output signals Q15, Q14, Q13, Q12, Q11 and Q10 from the divider 2, ranging in frequency from 1 Hz to 32 Hz, are applied to inputs of the AND gate 32. The output signal of the AND gate 32 has the waveform 47 shown in FIG. 13 which comprises a succession of one cycle per second pulses of 15.6 msec. The signals Q6 of 512 Hz and Q7 of 256 Hz are fed from the divider 2 to the inputs of the OR gate 33 and the output signal from the OR gate 33 together with the signal Q8 of 128 Hz are fed to the inputs of the OR gate 35. The output signal from the OR gate 35 is fed together with the signal Q9 of 64 Hz to the inputs of the AND gate 37. The output signal of the AND gate 37 is represented by waveform 48 and comprises a succession of pulses having a pulse width of 6.8 msec. and a period of 15.6 msec. The output signal from the OR gate 33 and the signal Q8 are also fed to the AND gate 36 whose output signal is fed to the OR gate 38 along with the signal Q9 and the output signal of the OR gate 38 comprises a succession of pulses having a pulse width of 10.7 msec. and a period of 15.6 msec. The inverted signals Q4 and Q5 of 1024 Hz and 2048 Hz, respectively, are fed to the two inputs of the OR gate 34 whose output signal comprises a succession of pulses having a pulse width of 0.24 msec. and a period of 0.98 msec. as represented by waveform 50.

The signals represented by waveforms 47, 48, 49 and 50 are synthesized by the AND gates 39 and 41 and the OR gate 40 to produce a succession of compound drive pulses having a period of one cycle per second as represented by waveform 51. The output signal 47 of the AND gate 32, which has a period of one cycle per second, is applied to the clock terminal CL of the D-flip-flop 42 which in response thereto switches the logic states of its outputs Q and $\overline{Q}$ every second. Consequently, the compound drive pulse signal 51 is alternately applied to the inverters 45 and 46 through AND gates 43 and 44, respectively, whose inputs are connected to respective ones of the Q and $\overline{Q}$ terminals of the flip-flop 42 as well as to the output of the AND gate 41. Thus the AND gates 43 and 44 are alternately enabled by the flip-flop 42 to alternately pass the compound drive pulse signal 51 to the inverters 45 and 46. The inverters 45 and 46 alternately apply drive signals 52 and 53 to respective terminals of the drive coil to energize the coil and rotationally drive the stepping motor 4 in a stepwise manner. The drive signals 52 and 53 have a waveform like that shown in FIG. 10A and effect sequential energization of the drive coil in first a full excitation state and then in an intermediate excitation state to thereby ensure stable rotational movement of the rotor in the forward direction in successive steps without mis-operation.

The logic elements shown in the circuitry of FIG. 12 can quite easily be connected in different arrangements to obtain drive signals having the waveforms shown in FIGS. 9, 10B and 10C as well as others. For the sake of brevity, these alternative circuit arrangements have not been shown in detail as it is understood that persons ordinarily skilled in the art would be easily able to arrange the logic elements to obtain the desired drive signal waveforms.

Figure 13:
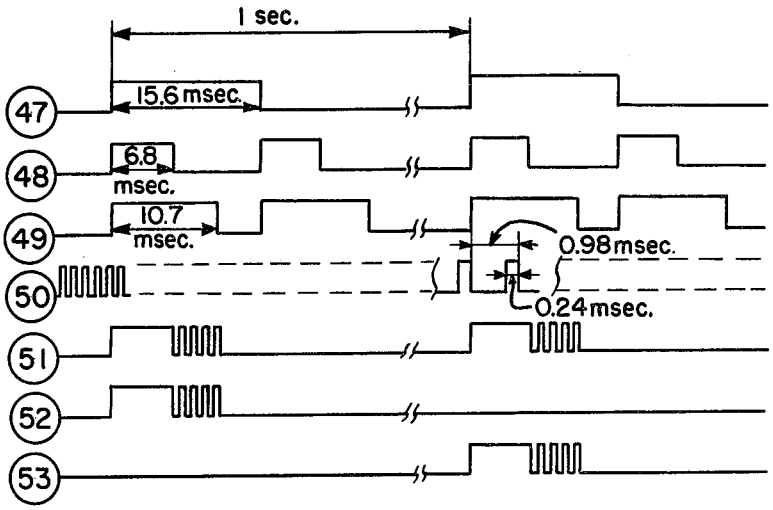
FIG. 13 shows waveforms of various signals produced by the circuitry shown in FIG. 12.

The foregoing description regarding FIGS. 12 and 13 pertains to a static pulse drive system in which one drive pulse is applied to the drive coil during each successive period, such as one pulse per second. The invention is equally applicable to compensated pulse drive systems in which more than one drive pulse can be applied to the drive coil in the same period. A conventional compensated pulse drive system will be explained with reference to FIGS. 14A and 14B.

Figure 14A:
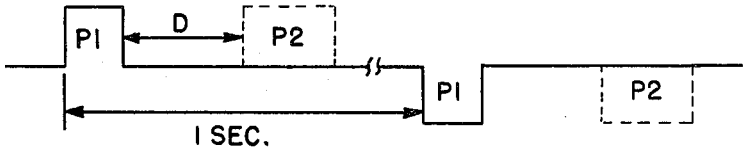
FIG. 14A PRIOR ART
FIGS. 14A and 14B are waveforms of prior art drive pulses of the type used in compensated pulse drive systems.

In a compensated pulse drive system, the analog electronic timepiece includes detecting means for detecting whether or not the rotor has rotated after the application of each normal drive pulse and in the event a non-rotation condition is detected, a correction drive pulse of greater pulse width than the normal drive pulse is applied to the drive coil within the same period to thereby effect rotor rotation. If the detecting means detects that the rotor has rotated in response to the application of the normal drive pulse to the drive coil, then no compensation is carried out and no correction drive pulse is applied to the drive coil. For example, as shown in FIG. 14A, within successive periods which, in this case, are of one second duration, a normal drive pulse P1 is applied to the drive coil in the normal manner and then in the time period D, the detecting means detects whether or not the rotor has rotated in response to the application of the normal drive pulse P1 and if not, a correction drive pulse P2 is then applied to the drive coil within the same one second period. The pulse width and pulse height of the normal drive pulses P1 are selected so that the normal drive pulses are sufficient to rotationally drive the stepping motor under normal load conditions and in like manner, the height and width of the correction drive pulses are selected to obtain the maximum drive torque needed to rotationally drive the motor under worst load conditions for which the timepiece has been designed. For example, additional drive torque would be required to operate a calendar mechanism or when the timepiece is placed in an external magnetic field or a low temperature environment. Within the design limits of the timepiece, the correction drive pulses are chosen to establish the necessary drive torque to rotationally drive the motor under these load conditions. One advantage of the compensated pulse drive system is that the normal drive pulses can be of shorter duration than those used in the static pulse drive system thereby obtaining a saving in overall electric power consumption.

Figure 14B:
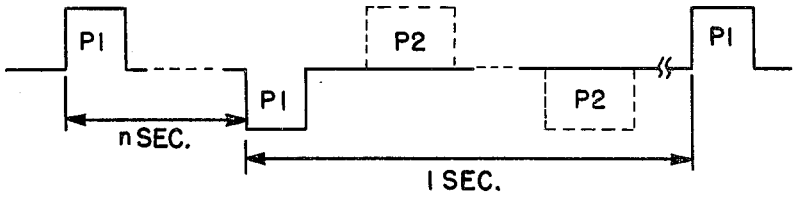
FIG. 14B PRIOR ART

Another type of compensated pulse drive system is shown in FIG. 14B. In this system, normal drive pulses P1 are successively applied to the drive coil during successive periods for a fixed period of time, for example, n seconds, irrespective of whether or not the rotor has failed to rotate in response to any of the drive pulses. Detecting means attached to the gear train detects the extent of rotation of the gear train carried out during the fixed period of n seconds to thereby determine the number of missed rotations and after such detection, the required number of correction drive pulses P2 are successively applied to the drive coil at a relatively high frequency so as to compensate for the missed rotations and thereby advance the rotor to the proper position so that the timepiece indicates the correct time. In this embodiment, the correction drive pulses are applied periodically every n seconds rather than each second as is the case with the embodiment of FIG. 14A.

Analog electronic timepieces employing the compensated pulse drive system are well known in the art and such systems are disclosed in U.S. Pat. Nos. 4,209,971 and 4,241,433 and allowed application Ser. No. 898,400 filed Apr. 28, 1978, and applications Ser. Nos. 169,312 filed July 16, 1980 and 966,115 filed Dec. 4, 1978, the disclosures of which are incorporated herein by reference. Compensated pulse drive systems are also disclosed in Japanese patent application Nos. 53-114467 and 54-75520.

Figure 15:
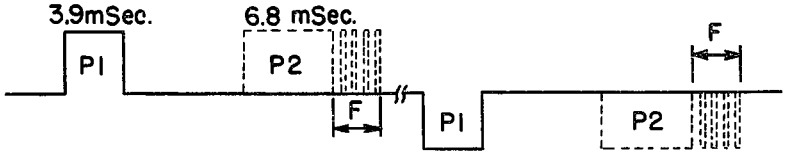
FIG. 15 is a waveform of drive pulses according to [illegible] needed to rotate the motor. On the other hand, [illegible]
Figure 16:
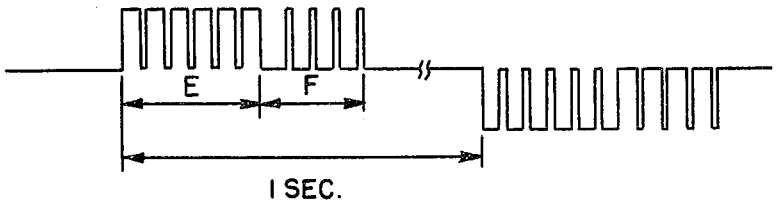

FIGS. 15 and 16 show two embodiments of the present invention incorporated in a compensated pulse drive system. The drive signal component used to energize the drive coil to the intermediate excitation state can be combined with either the normal drive pulses P1 or the correction drive pulses P2, or both. Generally, the normal drive pulses have a rather broad tolerance against mis-operation in the unstable rotation regions because of their low drive torque output. Therefore the effect of the present invention is comparatively small when applied to the normal drive pulses. On the other hand, the present invention is very effective in eliminating mis-operation of the stepping motor in the unstable rotation regions when it is applied to the correction drive pulses because the correction drive pulses produce the maximum drive torque output and have the longest pulse widths.

In the embodiment shown in FIG. 15, the drive signal comprises a normal drive pulse P1 having a pulse width of 3.9 msec. and a compound drive pulse composed of a correction drive pulse component P2 having a pulse width of 6.8 msec. and a secondary drive pulse component having a pulse width F. The secondary drive pulse component comprises four short duration pulses. The compound drive pulses shown in FIG. 15 are like the compound drive pulses shown in FIG. 10A. The normal drive pulse P1 is chosen to effect rotation of the rotor under predetermined load conditions and the compound drive pulse is selective to effect rotation of the rotor under worst case loading and includes the correction drive pulse component P2 for energizing the drive coil in the full excitation state and the secondary drive pulse component for energizing the drive coil in the intermediate excitation state.

In the embodiment shown in FIG. 16, the drive signal comprises a compound drive pulse having a first pulse component of pulse width E and a second pulse component of pulse width F for sequentially energizing the coil in the full and intermediate excitation states. Both of the first and second pulse components comprise sets of plural pulses with the plural pulses of the first set having a longer pulse width than the pulses of the second set. This type drive signal can be used with both the static pulse drive system and the compenstated pulse drive system and can be used with battery-powered timepieces employing batteries having an output voltage higher than 1.57 volts without requiring any circuitry modifications. This is due to the fact that the drive signal effectively reduces the mean drive power required to rotationally drive the motor. As shown in FIG. 16, the duty cycle of the pulses which comprise the first pulse component must be greater than the duty cycle of the pulses which comprise the second pulse component in order to obtain energization of the drive coil in the full and intermediate excitation states.

The present invention is not limited to use with timepieces employing stepping motors which advance one step per second and the invention is also applicable to timepieces using stepping motors which advance one step per several seconds. In the static pulse drive system, it is customary to incrementally advance or step the rotor one step per several or ten seconds as opposed to one step per second and the present invention is applicable to such systems. In these systems, the drive coil is periodically energized in periods which are longer than one second in a manner well known in the art.

The circuitry described with reference to FIGS. 12 and 13 can easily be modified by those ordinarily skilled in the art to arrange the logic elements to obtain drive signals having the waveform like that shown in FIG. 16. This would be done by connecting the logic elements so that the signal shown by waveform 48 is comprised of a plurality of pulses of short duration rather than a single pulse having a pulse duration of 6.8 msec.

In accordance with all embodiments of the invention, the timepiece circuitry sequentially energizes the drive coil in successive predetermined periods such that the drive coil is first energized in a full excitation state and immediately thereafter, is energized in an intermediate excitation state. The two excitation states are discrete, one from the other, and coact together to excite the stator to rotationally drive the rotor in a stepwise manner. The intermediate excitation state ensures that the rotor rotationally advances through one full step from an initial rest position to a new rest position by preventing return rotation of the rotor in the reverse direction once the rotor has forwardly rotated through a certain angular extent corresponding to the rotational angle at which the rotor begins oscillating in the forward and reverse directions. In this manner, the invention stabilizes the operation of the stepping motor and prevents mis-operation in the unstable rotation regions.

I claim:

1. In an electronic timepiece having a stepping motor comprised of a stator, rotor and drive coil; and time-indicating means connected to the stepping motor for indicating time in response to rotation of the rotor: circuit means for periodically energizing the drive coil by periodically applying thereto drive signals so as to rotationally drive the rotor in a stepwise manner in a forward direction of rotation, said circuit means including means operative during each energization period for sequentially energizing the drive coil first in a full excitation state by applying thereto a first drive signal component composed of a pulse of uniform voltage level to apply a given effective power to the drive coil effective to at least initiate driving of the rotor in the forward direction from an initial position through at least a 180° forward angle of rotation to a new position, and then in an intermediate excitation state by applying thereto a second drive signal component to apply effective power less than said given effective power to the drive coil effective to ensure completion of the driving of the rotor through said at least 180° forward angle of rotation by preventing return rotation of the rotor in the reverse direction back to its initial position after the rotor has forwardly rotated through a certain angular extent towards its new position thereby stabilizing the operation of the stepping motor.

2. An electronic timepiece according to claim 1; wherein said circuit means includes means for producing and applying to the drive coil during each energization period a second drive signal component composed of a pulse of predetermined pulse width to energize the drive coil in said intermediate excitation state.

3. An electronic timepiece according to claim 1; wherein said circuit means includes means for producing and applying to the drive coil during each energization period a second drive signal component composed of a plurality of pulses of the same polarity to energize the drive coil in said intermediate excitation state.

4. An electronic timepiece according to claim 1; wherein said circuit means comprises means for periodically generating drive signals of alternate polarity and successively applying the drive signals to the drive coil in successive energization periods to energize the dirve coil so as to rotationally drive the rotor, each drive signal having a first drive signal component effective to energize the drive coil in the full excitation state and a second drive signal component effective to energize the drive coil in the intermediate excitation state.

5. An electronic timepiece according to claim 4; wherein the first drive signal component of each drive signal has greater effective power that the second drive signal component.

6. An electronic timepiece according to claim 4; wherein the first drive signal component of each drive signal has a greater duration than the second drive signal component.

7. An electronic timepiece according to claim 4; wherein each drive signal comprises a compound drive pulse having a normal drive pulse component corresponding to the first drive signal component and effective to energize the drive coil in the full excitation state to at least initiate driving of the rotor in the forward direction through said at least 180° forward angle of rotation under normal loading, and a secondary drive pulse component corresponding to the second drive signal component and effective to energize the drive coil in the intermediate excitation state to ensure completion of the driving of the rotor through said at least 180° forward angle or rotation.

8. An electronic timepiece according to claim 1; wherein the secondary drive pulse component of each compound drive pulse comprises a plurality of pulses of the same polarity each having a pulse width substantially less than that of the normal drive pulse component.

9. An electronic timepiece according to claim 8; wherein at least some of the plurality of pulses which comprise the secondary drive pulse component of each compound drive pulse have different pulse widths.

10. An electronic timepiece according to claim 5; wherein each drive signal comprises a compound drive pulse having a first drive signal component which includes a correction drive pulse component effective to energize the drive coil in the full excitation state to at least initiate driving of the rotor in the forward direction through said at least 180° forward angle of rotation under worst case loading, and a secondary drive pulse component corresponding to the second drive signal component and effective to energize the drive coil in the intermediate excitation state to ensure completion of the driving of the rotor through said at least 180° forward angle of rotation.

11. An electronic timepiece according to claim 10; wherein the secondary drive pulse component of each compound drive pulse comprises a plurality of pulses of the same polarity each having a pulse width substantially less than that of the normal drive pulse component.

12. An electronic timepiece according to claim 11; wherein at least some of the plurality of pulses which comprise the secondary drive pulse component of each compound drive pulse have different pulse widths.

13. An electronic timepiece according to claim 10; wherein the correction drive pulse component of each compound drive pulse comprises a plurality of pulses of the same polarity.

14. An electronic timepiece according to any one of claims 1, 4, 7 and 10; wherein said circuit means includes means for periodically energizing the drive coil in energization periods longer than one second.

15. An electronic timepiece according to any one of claims 4, 7 and 10; wherein the first drive signal component of each drive signal has a duration of about 6.8 milliseconds.

16. A method of operating a stepping motor having a stator, rotor and drive coil to rotationally drive the time-indicating means of an electronic timepiece, the method comprising: periodically energizing the drive coil by periodically applying thereto drive signals to rotationally drive the rotor in a stepwise manner in a forward direction of rotation; and during each energization period sequentially energizing the drive coil first in a full excitation state by applying thereto a first drive signal component composed of a pulse of unifrom voltage level to apply a given effective power to the drive coil to at least initiate driving of the rotor in the forward direction from an initial position through at least a 180° forward angle of rotation to a new position, and then in an intermediate excitation state by applying thereto a second drive signal component to apply effective power less than said given effective power to the drive coil to insure completion of the driving of the rotor through said at least 180° forward angle of rotation by preventing return rotation of the rotor in the reverse direction back to its initial position after the rotor has forwardly rotated through a certain angular extent towards its new position thereby stabilizing the operation of the stepping motor.

17. A method according to claim 16; wherein the step of energizing the drive coil includes producing and applying to the drive coil during each energization period a second drive signal component composed of a pulse of predetermined pulse width to energize the drive coil in said intermediate excitation state.

18. A method according to claim 16; wherein the step of energizing the drive coil includes producing and applying to the drive coil during each energization period a second drive signal component composed of a plurality of pulses of the same polarity to energize the drive coil in said intermediate excitation state.

19. A method according to claim 16; wherein the step of energizing the drive coil comprises periodically generating drive signals of alternate polarity and successively applying the drive signals to the drive coil in successive energization periods to energize the drive coil so as to rotationally drive the rotor, each drive signal having a first drive signal component effective to energize the drive coil in the full excitation state and a second drive signal component effective to energize the drive coil in the intermediate excitation state.

20. A method according to claim 19; wherein the first drive signal component of each drive signal has greater effective power than the second drive signal component.

21. A method according to claim 19; wherein the first drive signal component of each drive signal has a greater duration than the second drive signal component.

22. A method according to claim 19; wherein each drive signal comprises a compound drive pulse having a normal drive pulse component corresponding to the first drive signal component and effective to energize the drive coil in the full excitation state to at least initiate driving of the rotor in the forward direction through said at least 180° forward angle of rotation under normal loading, and a secondary drive pulse component corresponding to the second drive signal component and effective to energize the drive coil in the intermediate excitation state to ensure completion of the driving of the rotor through said at least 180° forward angle of rotation.

23. A method according to claim 22; wherein the secondary drive pulse component of each compound drive pulse comprises a plurality of pulses of the same polarity each having a pulse width substantially less than that of the normal drive pulse component.

24. An electronic timepiece according to claim 23; wherein at least some of the plurality of pulses which comprise the secondary drive pulse component of each compound drive pulse have different pulse widths.

25. A method according to claim 19; wherein each drive signal comprises a compound drive pulse having a first drive signal component which includes a correction drive pulse component effective to energize the drive coil in the full excitation state to at least initiate driving of the rotor in the forward direction through said at least 180° forward angle of rotation under worst case loading, and a secondary drive pulse component corresponding to the second drive signal component and effective to energize the drive coil in the intermediate excitation state to ensure completion of the driving of the rotor through said at least 180° forward angle of rotation.

26. A method according to claim 25; wherein the secondary drive pulse component of each compound drive pulse comprises a plurality of pulses of the same polarity each having a pulse width substantially less than that of the normal drive pulse component.

27. A method according to claim 26; wherein at least some of the plurality of pulses which comprise the secondary drive pulse component of each compound drive pulse have different pulse widths.

28. A method according to claim 25; wherein the correction drive pulse component of each compound drive pulse comprises a plurality of pulses of the same polarity.

29. A method according to any one of claims 16, 19, 22 and 25; wherein the step of energizing the drive coil includes periodically energizing the drive coil in energization periods longer than one second.

30. A method according to any one of claims 19, 22 and 25; wherein the first drive signal component of each drive signal has a duration of about 6.8 milliseconds.

31. An electronic timepiece according to claim 3; wherein the second drive signal component of each drive signal comprises a plurality of pulses each having the same pulse width.

32. An electronic timepiece according to claim 31; wherein the plurality of pulses which comprise each second drive signal component each have the same duty ratio.

33. An electronic timepiece according to claim 3; wherein the second drive signal component of each drive signal comprises a plurality of pulses each having the same duty ratio.

34. In an electronic timepiece having a stepping motor comprised of a stator, rotor and drive coil; and time-indicating means connected to the stepping motor for indicating time in response to rotation of the rotor; circuit means for periodically energizing the drive coil by periodically applying thereto drive signals so as to rotationally drive the rotor in a stepwise manner in a forward direction of rotation, said circuit means including means operative during each energization period for sequentially energizing the drive coil first in a full excitation state by applying thereto a first drive signal component composed of a pulse of uniform voltage level to apply a given effective power to the drive coil effective to at least initiate driving of the rotor in the forward direction from an initial position through a predetermined forward angle of rotation to a new position, and then in an intermediate excitation state by applying thereto a second drive signal component composed of a plurality of pulses each having the same pulse width and the same duty ratio to apply effective power less than said given effective power to the drive coil effective to ensure completion of the driving of the rotor through said predetermined forward angle of rotation by preventing return rotation of the rotor in the reverse direction back to its initial position after the rotor has forwardly rotated through a certain angular extent towards its new position thereby stabilizing the operation of the stepping motor.

35. An electronic timepiece according to claim 34; wherein said circuit means includes means for producing and applying drive signals to the drive coil to effect stepwise driving of the rotor through predetermined forward angles of rotation of at least 180°.

* * * * *